US006336399B1

(12) United States Patent
Matsuoka

(10) Patent No.: US 6,336,399 B1
(45) Date of Patent: Jan. 8, 2002

(54) ENERGIZING DEVICE FOR A PRESS DIE

(75) Inventor: Mitsuo Matsuoka, Osaka (JP)

(73) Assignee: Umix Co., Ltd., Osaka (JP)

( * ) Notice: Subject to any disclaimer, the term of this patent is extended or adjusted under 35 U.S.C. 154(b) by 0 days.

(21) Appl. No.: 09/465,803

(22) Filed: Dec. 17, 1999

(30) Foreign Application Priority Data

Nov. 15, 1999 (JP) ..... 11-324065

(51) Int. Cl.[7] ..... B30B 1/00
(52) U.S. Cl. ..... 100/266; 72/445; 72/452.9
(58) Field of Search ..... 100/266; 72/452.9, 72/445, 313, 314, 315, 387; 83/588

(56) References Cited

U.S. PATENT DOCUMENTS 4,342,214 A * 8/1982 Neuendorf ..... 72/404
4,471,680 A * 9/1984 Gerhart ..... 83/588
5,101,705 A * 4/1992 Matsuoka ..... 72/452.9
5,341,669 A * 8/1994 Katz ..... 72/313
5,711,180 A * 1/1998 Sasahara et al. ..... 72/452.9
5,881,599 A * 3/1999 Sasahara et al. ..... 72/452.9
5,884,521 A * 3/1999 Fidziukiewicz ..... 72/452.9

* cited by examiner

*Primary Examiner*—Peter Vo
*Assistant Examiner*—Louis Huynh

(57) ABSTRACT

A press die includes a lower die, a slide cam movable along the lower die, and an energizing body disposed between the slide cam and the lower die to abut against both surfaces thereof for biasing the slide cam for movement in one direction along the lower die. The slide cam is provided with a plug having an outer diameter that is larger than an outer diameter of the energizing body and abutting against an end surface of the energizing body. This arrangement enables easy attachment and detachment of the energizing body to and from the press die.

20 Claims, 8 Drawing Sheets

ENERGIZING DEVICE FOR A PRESS DIE

BACKGROUND OF THE INVENTION

1. Field of the Invention

The present invention relates to an energizing device for a press die, and more particularly, to an energizing device for a press die that can be easily attached and detached and that is provided to be sufficiently safe.

2. Description of the Background Art

A conventional energizing device for a press die is shown in FIG. 7 and FIG. 8. In such a press die, a workpiece, W is mounted on a supporting portion 102 of a lower die 101 such that a hole 105 may be formed in a piercing manner on a lateral surface of the workpiece W by means of a punch 104 that is horizontally arranged with respect to a passive cam 103 performing sliding movements in a lateral direction, wherein the passive cam 103 is driven by an active cam 107 of an upper die 106.

In FIG. 7, the mold assumes a condition at a dead bottom center, and upon completion of the hole forming process, the upper die 106 is raised, and in the absence of pressuring force applied by the active cam 107, the passive cam 103 is retracted through an energizing force of a coil spring 108 that is provided at a lower portion of the cam until it abuts against a terminating surface 110 of a wall body 109.

Here, the coil spring 108 which functions to retract the passive cam 103 is arranged in that it is outwardly fitted to a guide pin 112 that is formed to be extruded in a horizontal condition by being screwed to a rising wall 111 such that one end surface abuts against the rising wall 111, and the other end surface is made to abut against a supporting plate 113 wherein this supporting plate 113 is fixed to the passive cam 103 by means of a bolt 114.

The supporting plate 113 includes a groove 115 that is open in a downward direction such that the guide pin 112 may be taken out at the time of performing maintenance or inspection. Due to the groove 115 in the supporting plate 113, one part of the coil spring 108 abuts against the supporting plate 113, while a remaining part of the coil spring 108 extends over the groove 115 and is not supported by the supporting plate 113 such that fit of the coil spring 108 with respect to the supporting plate 113 becomes unstable. Consequently, the coil spring 108 can no longer be disposed in a horizontal condition, which results in cases in which the coil spring 108 abuts against an outer periphery of the guide pin 112, such that the guide pin 112 is worn or the coil spring 108 is deformed or seized so that the energizing device may not be completely actuated.

It is desirable to have an energizing device for a press die which is capable of eliminating the above-mentioned drawbacks such as the occurrence of deformation or seizing of the coil spring or damage to the guide pin, and which presents favorable operatability by enabling the coil spring or the guide pin to be easily attached or detached at the time of performing maintenance or inspection without the necessity of detaching the press die from the press machine while such operations can be performed in a safe manner.

In view of these facts, the energizing device for a press die according to the present invention has been devised with an energizing body for energizing a press member, by being disposed between two members to abut against both surfaces thereof so as to enable easy attaching/detaching of the energizing body while maintaining a condition in which the energizing body is attached to a press machine, wherein one of the members is provided with a plug of an outer diameter that is larger than an outer diameter of the energizing body and abutting against an end surface of the energizing body.

The energizing device for a press die of the present invention is particularly arranged in that the plug is threaded into the one member in order to be attached to the one member. A hexagonal taking-out hole is formed in a concave manner on a surface of the plug opposite to a surface of the plug which abuts with the energizing body.

Moreover, the press die includes a taking-out hole of an inner diameter that is larger than the outer diameter of the plug and which is pierced through a wall body of a lower die that is disposed so as to oppose the plug. Further, the press die may include a safety device for preventing jumping-out of the plug and/or the energizing body. The safety device is a safety plate that may be provided in a freely attachable/detachable manner to the one member so as to oppose the plug, or may be provided in a freely attachable/detachable manner on the wall body so as to oppose the plug.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION OF THE PREFERRED EMBODIMENTS

Figure 1:
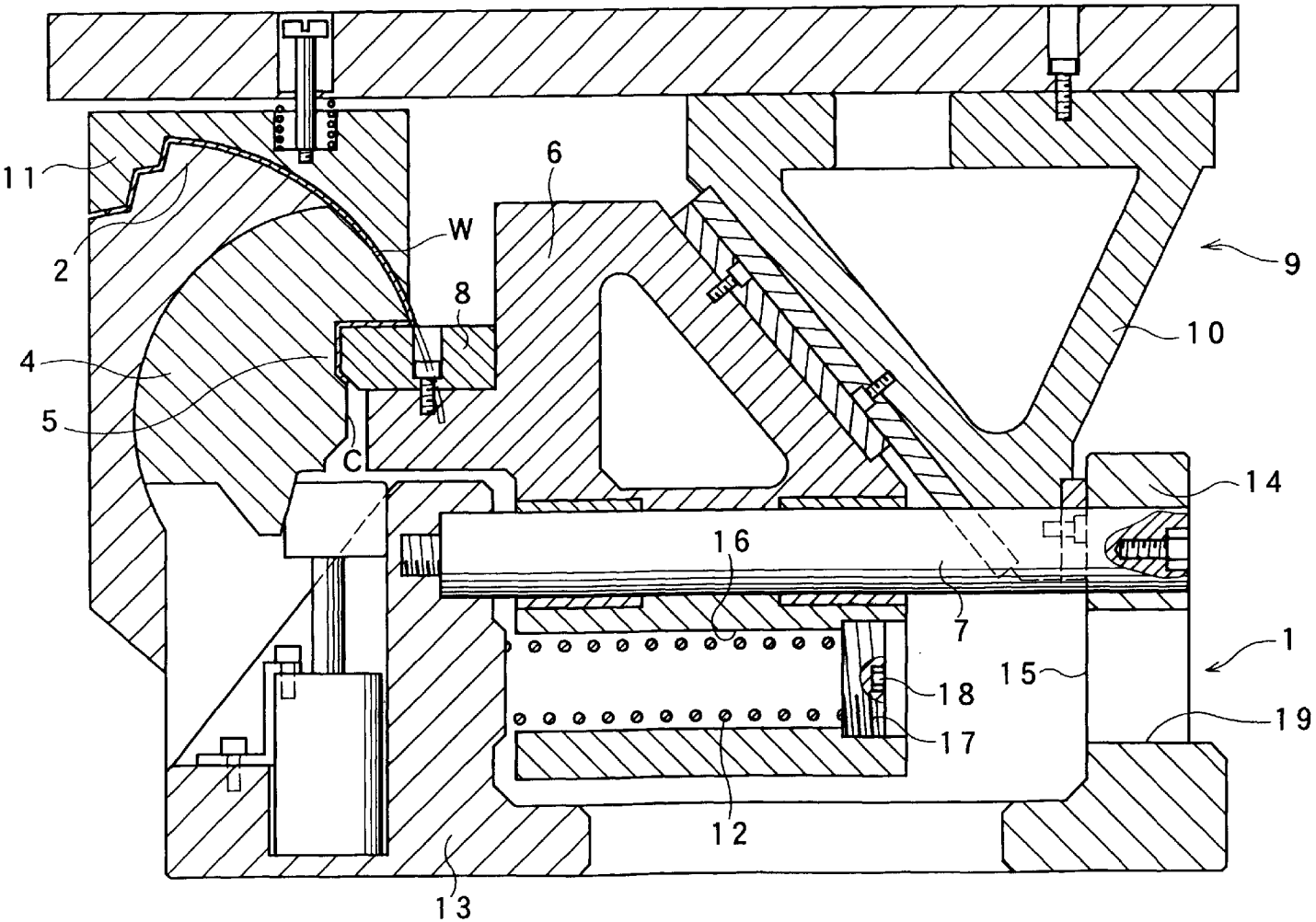
FIG. 1 is a longitudinal sectional view showing a condition at a bottom dead center according to one embodiment of the energizing device for a press die according to the present invention.

Preferred embodiments of the present invention as shown in the accompanying drawings will now be explained in details herein below. FIG. 1 shows a press die at a bottom dead center wherein a workpiece W is, for instance, formed with a negative angle. In the drawing, a lower die 1 is comprised with a supporting portion 2 for the workpiece W on the leftward upper side when seen in the drawing, and a columnar body 4 is provided below the supporting portion in a freely rotating manner which includes an intruding forming portion 5 located above a center C of the columnar body 4. A slide cam 6 is provided at a horizontally arranged guide pin 7 in a freely sliding manner, and negative angle forming is performed through an intruding forming portion 8 that is formed at a leftward upper side of the slide cam 6 and the intruding forming portion 5 of the columnar body 4. An upper die 9 is provided with an active cam 10 that descends to drive the sliding cam 6. It should be noted that reference number 11 denotes a pad.

Figure 2:
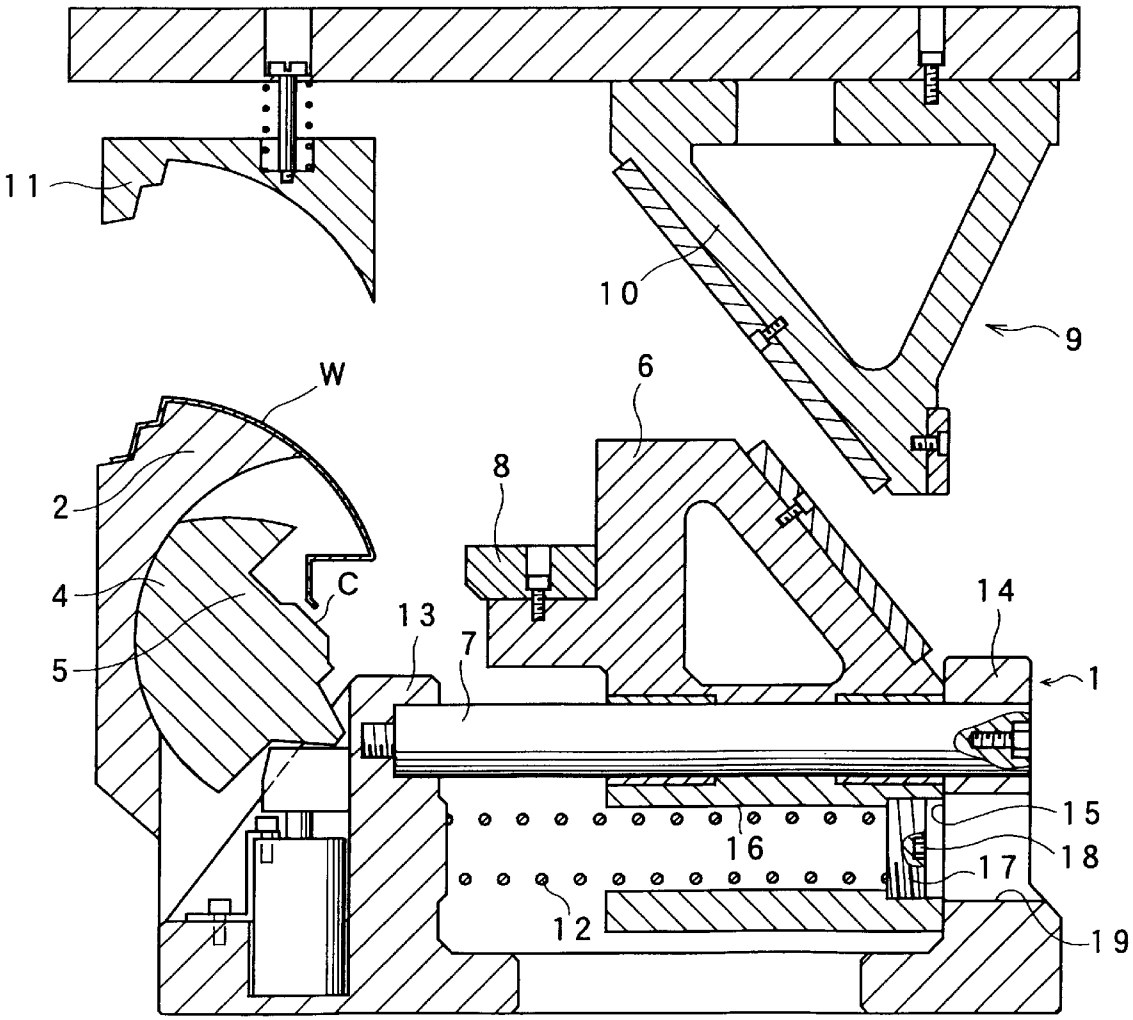
FIG. 2 is a longitudinal sectional view showing a condition of FIG. 1 at a top dead center.

Upon completion of negative angle forming, the upper die 9 is raised as shown in FIG. 2. For retracting the slide cam 6 upon rising of the upper die 9, a coil spring 12 is provided at a lower portion of the slide cam 6.

The guide pin 7 is horizontally arranged between a rising wall 13 of the lower die 1 and a wall body 14, and the slide cam 6 performs sliding movements through this guide pin 7. In case a driving force applied to the slide cam 6 is released upon rising of the active cam 10, the slide cam 6 is energized by the energizing force of the coil spring 12 that is provided at the lower portion of the slide cam 6 until the slide cam 6 reaches a terminating surface 15 of the wall body 14.

The coil spring 12 is attached to an attaching hole 16 that is horizontally pierced through a lower portion of the slide cam 6 such that one end surface of the spring abuts against a wall surface of the rising wall 13 and the other end surface is attached by being abutted against a plug 17 which has an outer diameter that is larger than an outer diameter of the coil spring 12. An end surface on an opposite side of the plug 17 at which the coil spring 12 abuts is formed with a concave hexagonal hole 18 for taking-out, and a taking-out aperture 19 is formed through the wall body 14 opposing the hexagonal hole 18 of the plug 17, and having a dimension that is larger than the outer diameter of the plug 17.

For taking out the coil spring 12 or the plug 17, a tip of a rotating rod (not shown) having a hexagonal shape is inserted from the taking-out aperture 19 of the wall body 14 into a hexagonal hole 18 of the plug 17 and is rotated for detaching the plug 17 whereupon the coil spring 12 can be taken out. At the time of attaching the coil spring 12, the rod is again inserted from the taking-out aperture 19 of the wall body 14 into an attaching hole 16 of the slide cam 6 whereupon the plug 17 is inserted from the taking-out aperture 19 of the wall body 14 and screwed thereat to abut against the end surface of the coil spring 12.

While the above explanation is based on an example in which the energizing body of the energizing device for a press die is a coil spring, the energizing body is not limited to a coil spring but may also be made of urethane rubber or cushion rubber, and it may further be a gas spring or any other energizing body.

Figure 3:
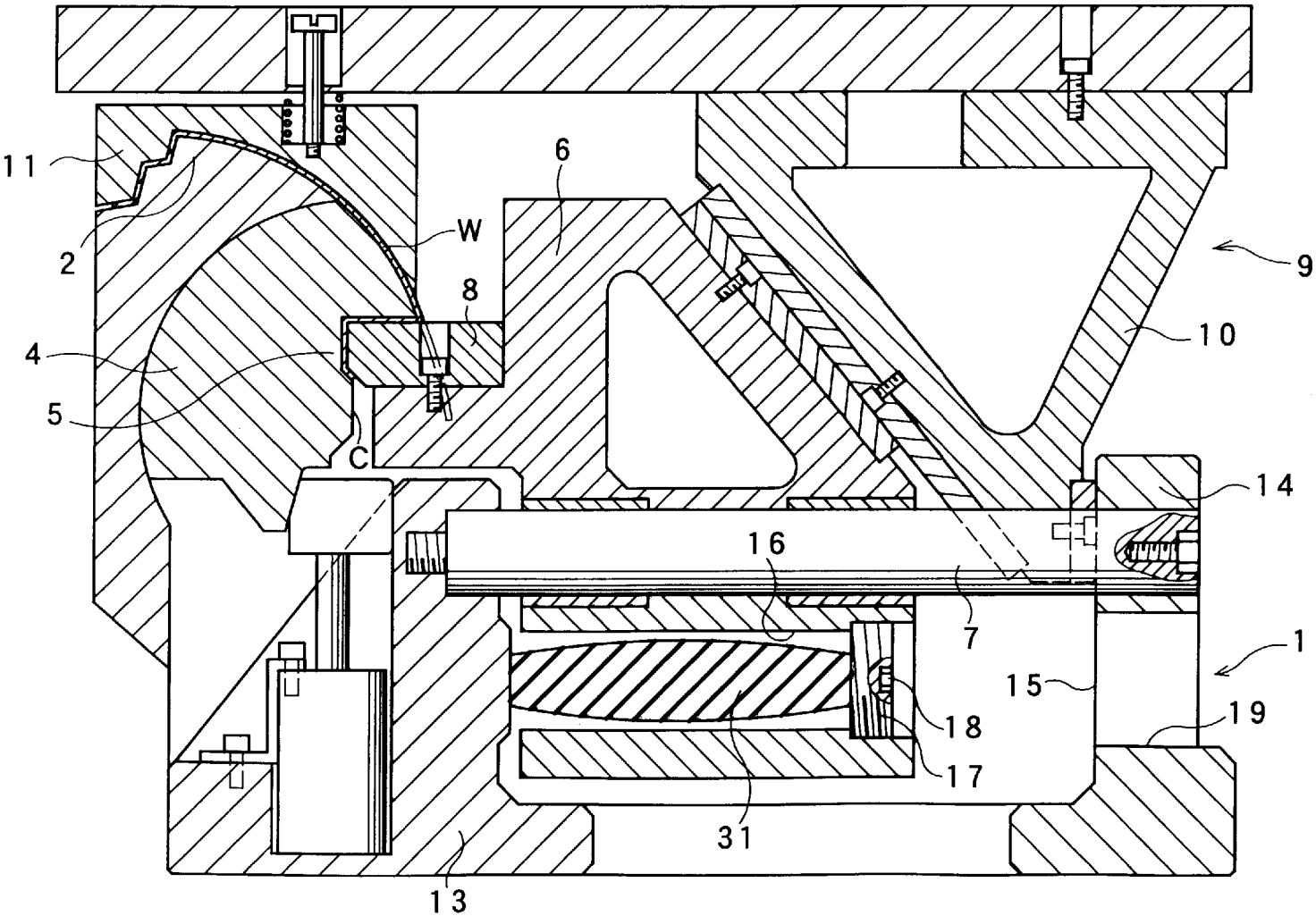
FIG. 3 is a longitudinal sectional view showing a condition at a bottom dead center according to another embodiment of the energizing device for a press die according to the present invention employing urethane rubber as an energizing body.
Figure 4:
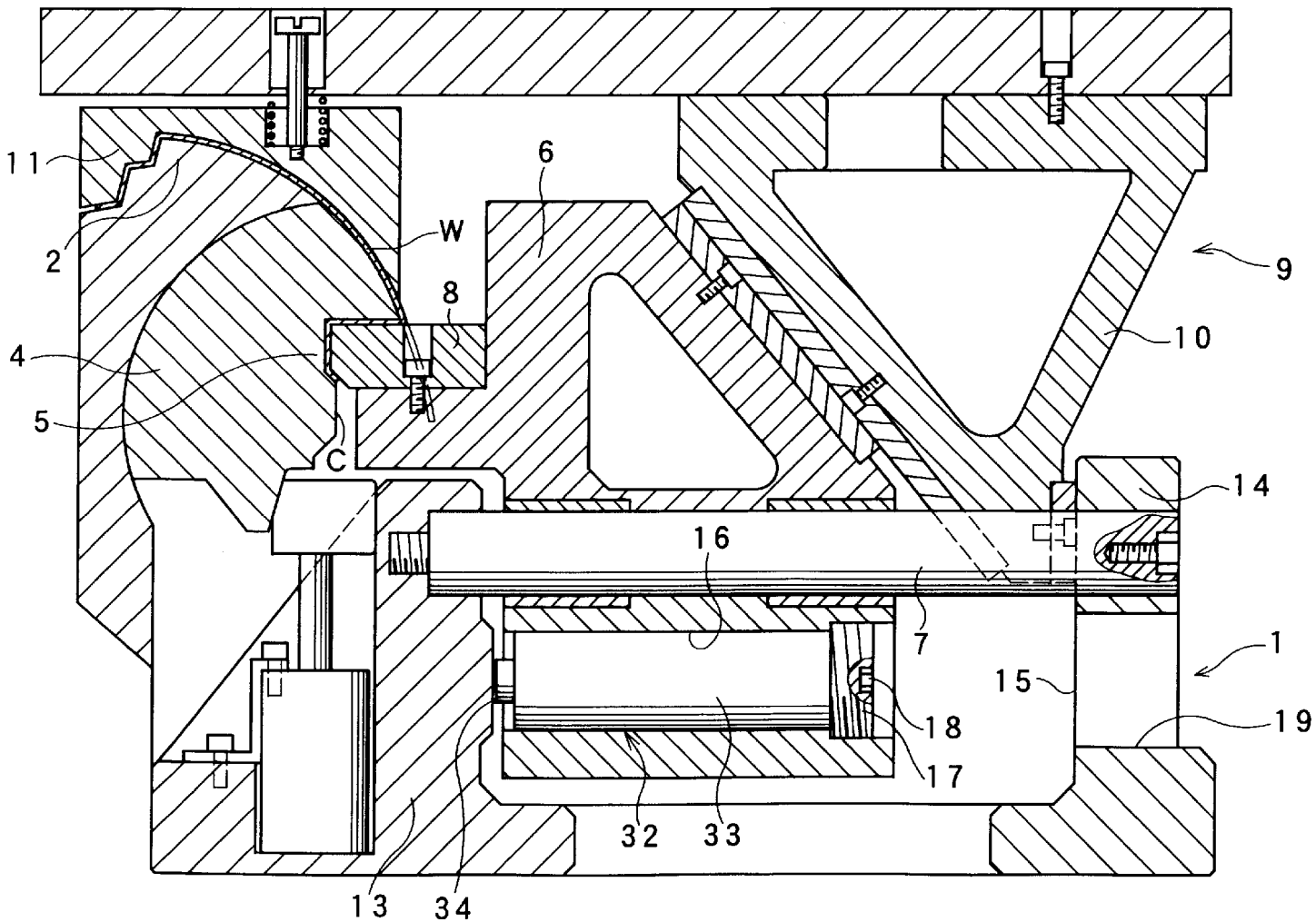
FIG. 4 is a longitudinal sectional view showing a condition at a bottom dead center according to still another embodiment of the energizing device for a press die according to the present invention employing a gas spring as an energizing body.

FIG. 3 shows an example in which the energizing body is urethane rubber 31, and FIG. 4 shows an example in which the energizing body is a gas spring 32. The gas spring 32 accumulates high-pressure gas in a cylinder 33 thereof, e.g. high-pressure gas of 150 km/cm$^2$, depending to various purposes, and even though a rod 34 extruding from the cylinder 33 is expanded or retracted, a substantially constant output of, e.g. 150 km/cm$^2$, can be obtained during the entire length of the expanding and retracting process of the rod. The substantially constant output can be achieved during the entire process of the rod 34 through two tanks that are incorporated within the cylinder 33 wherein in case the rod 34 is retracted and pressure is applied to one tank, high-pressure gas is made to flow out from this tank to flow into the other tank.

In this manner, the gas spring 32 is capable of performing high output from the start of actuation and during the entire process unlike a case with the coil spring 12 whereby the slide cam 6 can be reliably returned to ensure safety.

Further, by the use of the gas spring 32, the slide cam 6 is enabled to move a distance as long as 150 mm, and processing of a large-sized workpiece of thin plate is also enabled.

Figure 5:
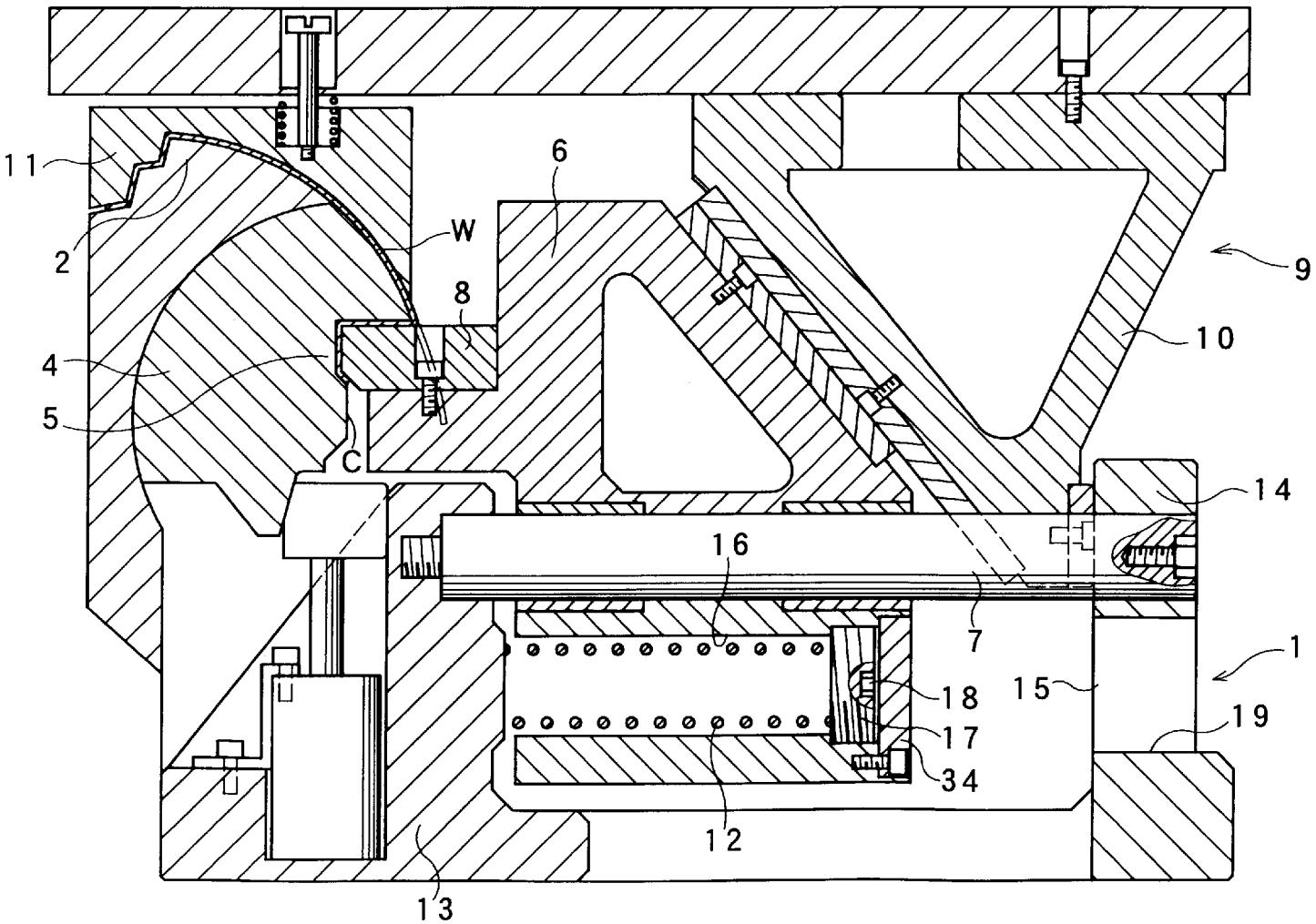
FIG. 5 is a longitudinal sectional view showing the energizing device for a press die that is provided with a freely attachable/detachable safety plate at a slide cam opposing a plug.
Figure 6:
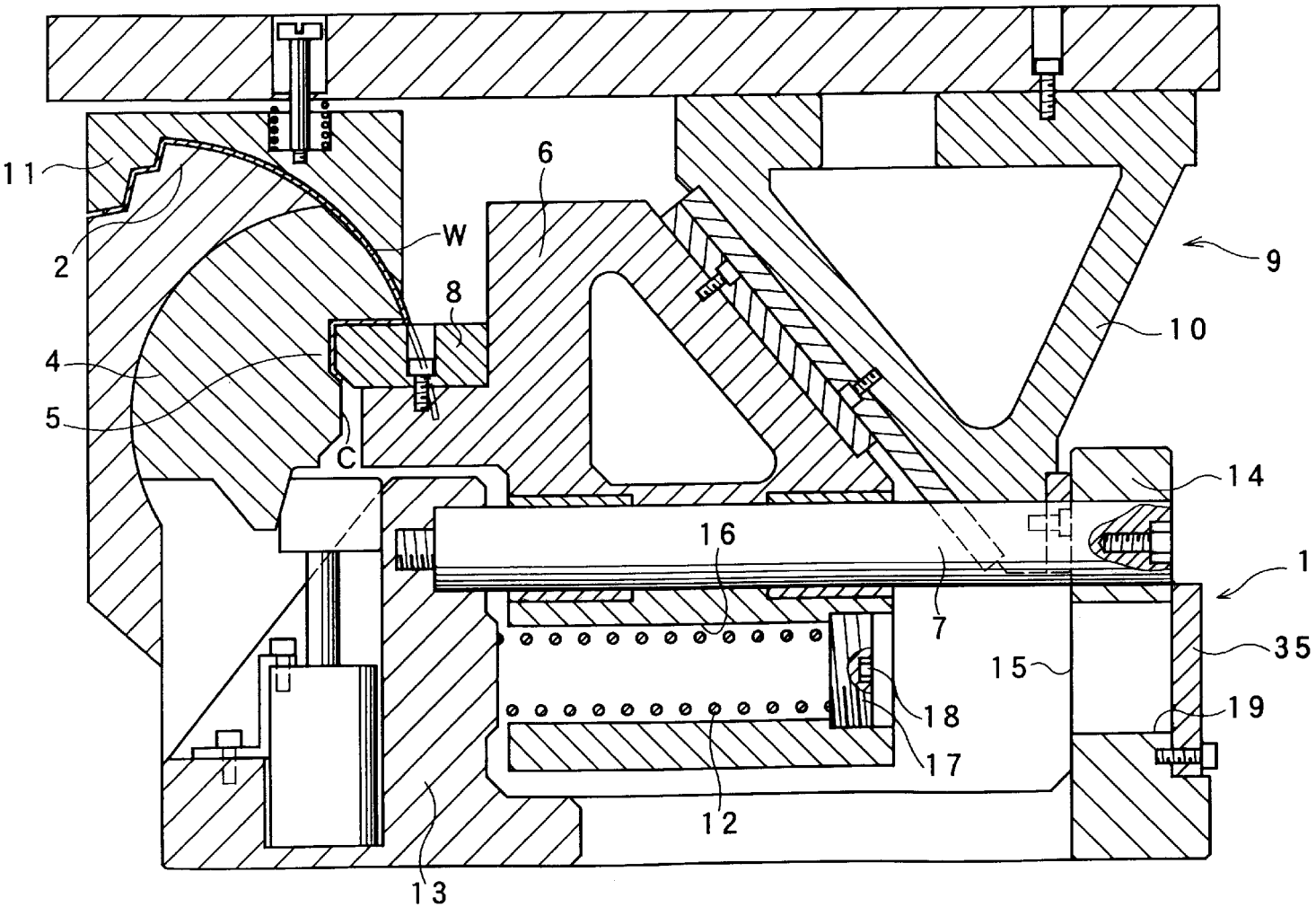
FIG. 6 is a longitudinal sectional view showing the energizing device for a press die that is provided with a freely attachable/detachable safety plate at a portion of a wall body blocking a taking-out hole.
Figure 7:
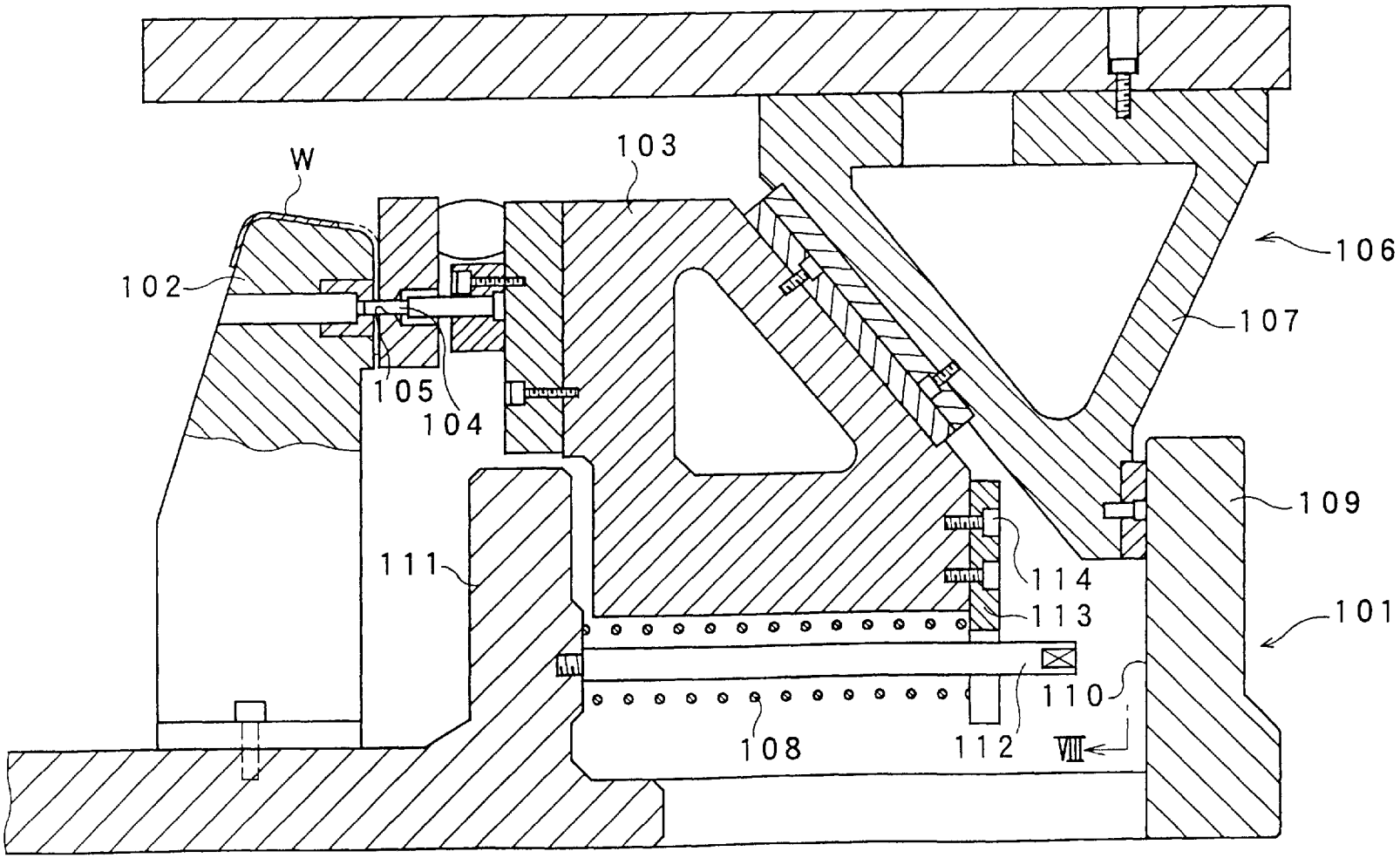
FIG. 7 BACKGROUND ART
FIG. 7 is a longitudinal sectional view showing a conventional energizing device for a press die at a bottom dead center.
Figure 8:
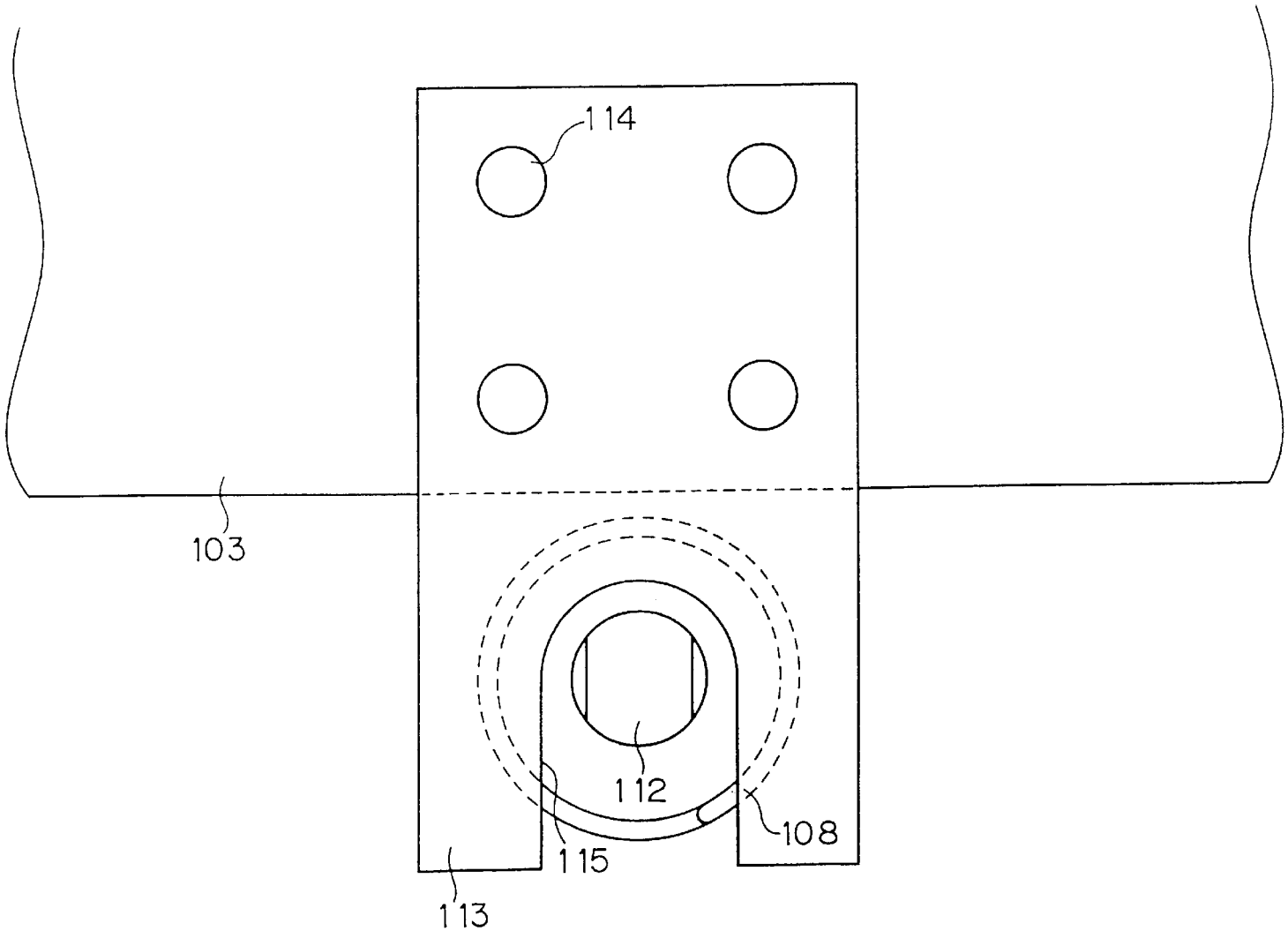
FIG. 8 BACKGROUND ART
FIG. 8 is a view showing main parts of the energizing device of FIG. 7 seen from a direction of arrow VIII.

Due to the provision of the taking-out aperture 19 at the wall body 14 at a portion opposing the plug 17 and the energizing body, it may happen that the plug 17 or the energizing body, or the plug 17 and the energizing body, may jump out through the taking-out aperture 19 and to hit against an operator in case the plug 17 comes off owing to oscillation during usage owing to the fact that the energizing body is highly pressurized. In order to prevent this from happening to improve operatability and to secure safety, a safety plate 34 may be attached at a position opposing the plug 17 of the slide cam 6 as shown in FIG. 5 or a safety plate 35 at the wall body 14 as shown in FIG. 6.

As explained so far, the energizing device for a press die according to the present invention has been devised to be an energizing device for a press die that is comprised with an energizing body for energizing a press member by being disposed between two members to abut against both surfaces thereof, wherein one of the members is provided with a plug of an outer diameter that is larger than an outer diameter of the energizing body and abutting against an end surface of the energizing body. With this arrangement, easy attaching/detaching of the energizing body for energizing a press member can be performed while maintaining a condition in which the energizing body is attached to a press die so that operatability is improved.

The energizing device for a press die of the present invention is particularly arranged in that the plug is threaded into the one member in order to be attached to the one member. A hexagonal taking-out hole is formed in a concave manner on a surface of the plug opposite to a surface of the plug which abuts with the energizing body.

Moreover, the press die includes a taking-out hole of an inner diameter that is larger than the outer diameter of the plug and which is pierced through a wall body of the lower die that is disposed so as to oppose the plug. Further, the press die may include a safety device for preventing jumping-out of the plug and/or the energizing body. With this arrangement, easy attaching/detaching of the energizing body for energizing a press member can be performed while maintaining a condition in which it is attached to a press die so that operatability is improved.

The safety device is safety plate that may be provided in a freely attachable/detachable manner to the slide cam so as to oppose the plug, or may be provided in a freely attachable/detachable manner on the wall body so as to oppose the plug.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A press apparatus comprising:

an upper die including an active cam;

a lower die including a first wall and a second wall;

a guide member extending between said first wall and said second wall;

a slide cam slidably mounted on said guide member, said slide cam being structured and arranged to be contact-pressed and driven by said active cam;

a cavity located within said slide cam, said cavity including a removable plug at one end thereof;

an energizing member arranged partially within said cavity and between said first wall and said plug; and an aperture provided in said second wall of said lower die, said aperture being aligned with said plug, whereby said plug and said energizing member are removable from said cavity through said aperture in said second wall.

2. The press apparatus according to claim 1, wherein said energizing member has a first diameter, and said plug has a second diameter larger than said first diameter.

3. The press apparatus according to claim 1, wherein said plug includes a tool-receiving socket therein for removing said plug from said cavity.

4. The press apparatus according to claim 1, wherein said plug is threadably engaged with said slide cam.

5. The press apparatus according to claim 1, wherein said energizing member comprises a coil spring.

6. The press apparatus according to claim 1, wherein said energizing member comprises a gas spring.

7. The press apparatus according to claim 1, wherein said energizing member comprises a rubber cushion.

8. The press apparatus according to claim 1, further comprising a safety plate attached to said slide cam, said plug being located between said energizing member and said safety plate.

9. The press apparatus according to claim 1, further comprising a safety plate attached to said second wall and at least partially covering said aperture in said second wall.

10. The press apparatus according to claim 1, wherein said guide member includes a guide pin mounted across said lower die, said guide pin having a first end portion fitted into a first fitting hole in said first wall, and a second end portion fitted into a second fitting hole in said second wall.

11. The press apparatus according to claim 10, further comprising a guide aperture located in said slide cam, said guide aperture slidably receiving said guide pin therein so that the slide cam is slidable on the guide pin.

12. The press apparatus according to claim 1, wherein said energizing member comprises a coil spring having a first diameter, and said plug is threadably engaged with said slide cam and has a second diameter larger than said first diameter.

13. A press apparatus comprising:

an upper die including an active cam;

a lower die including a first wall and a second wall;

a guide post attached to at least one of said first wall and said second wall;

a slide cam including a guide aperture therein, said guide aperture slidably receiving said guide post therein so that the slide cam is slidable on said guide post;

a cavity located within said slide cam, said cavity including a removable plug at one end thereof; and an energizing member arranged at least partially within said cavity and between said first wall and said plug for biasing said slide cam away from said first wall.

14. The press apparatus according to claim 13, further comprising an aperture provided in said second wall of said lower die, said aperture being aligned with said plug, whereby said plug and said energizing member are removable from said cavity through said aperture in said second wall.

15. The press apparatus according to claim 14, wherein said energizing member comprises a coil spring having a first diameter, and said plug is threadably engaged with said slide cam and has a second diameter larger than said first diameter.

16. The press apparatus according to claim 14, further comprising a safety plate attached to said second wall and at least partially covering said aperture in said second wall.

17. The press apparatus according to claim 13, further comprising a safety plate attached to said slide cam, said plug being located between said energizing member and said safety plate.

18. The press apparatus according to claim 13, wherein said energizing member comprises a coil spring having a first diameter, and said plug is threadably engaged with said slide cam and has a second diameter larger than said first diameter.

19. The press apparatus according to claim 13, wherein said guide post is attached to said first wall and said second wall.

20. The press apparatus according to claim 13, wherein said guide post has a first end portion fitted into a first fitting hole in said first wall, and a second end portion fitted into a second fitting hole in said second wall.

* * * * *